US009518412B2

(12) United States Patent
Moroz

(10) Patent No.: US 9,518,412 B2
(45) Date of Patent: Dec. 13, 2016

(54) DOOR SECURITY DEVICE

(71) Applicant: Steven Moroz, Auburn, CA (US)

(72) Inventor: Steven Moroz, Auburn, CA (US)

( * ) Notice: Subject to any disclaimer, the term of this patent is extended or adjusted under 35 U.S.C. 154(b) by 231 days.

(21) Appl. No.: 14/329,125

(22) Filed: Jul. 11, 2014

(65) Prior Publication Data

US 2016/0010373 A1 Jan. 14, 2016

(51) Int. Cl.
*E05C 19/00* (2006.01)
*E05B 65/08* (2006.01)
*E05C 17/44* (2006.01)

(52) U.S. Cl.
CPC ..... *E05C 19/003* (2013.01); *E05B 65/0888* (2013.01); *E05C 19/00* (2013.01); *E05C 19/004* (2013.01)

(58) Field of Classification Search
CPC ..... E05C 19/00; E05C 19/003; E05C 19/004; E05B 65/0888
USPC ..... 292/259 R, 338, 339
See application file for complete search history.

(56) References Cited

U.S. PATENT DOCUMENTS 266,564 A * 10/1882 Ward ..... E05B 83/10 220/314
282,598 A * 8/1883 Zimmerman ..... E05B 65/0007 109/62
3,819,216 A * 6/1974 Richardson ..... E05C 19/003 292/259 R
3,856,373 A * 12/1974 Tucich ..... E05B 65/467 292/259 R
3,980,328 A * 9/1976 Pearson ..... E05C 19/003 220/315
4,330,147 A * 5/1982 Nolen ..... E05C 19/003 292/259 R
4,602,720 A * 7/1986 Mattsson ..... E05B 83/12 220/315
4,852,921 A * 8/1989 Gilbert ..... E05C 19/003 292/259 R
4,856,831 A * 8/1989 Roden, Jr. ..... E05C 19/003 292/259 R
5,014,527 A * 5/1991 Traller ..... E05B 13/001 292/259 R
5,077,940 A * 1/1992 LaRose, Jr. ..... E05C 19/003 292/259 R
5,290,077 A 3/1994 Fleming
5,340,172 A * 8/1994 Sweet ..... E05C 19/003 292/259 R
5,580,108 A 12/1996 Bergstein
5,605,364 A * 2/1997 Shelledy ..... E05C 19/003 292/259 R
5,669,641 A 9/1997 Jeansonne
5,727,823 A * 3/1998 Wiley ..... E05C 19/003 292/259 R (Continued)

*Primary Examiner* — Carlos Lugo
(74) *Attorney, Agent, or Firm* — Harpman & Harpman

(57) ABSTRACT

A security entry door device for preventing force forward motion entry through and exterior door of a structure. The door security device includes a steel security pole removably anchored to the floor and slidably secured within a retainment bracket anchored to the structural wall header above the door opening. A parallel door engagement push bar adjustably extends against the pole brace to engage the door vertically along its length, securing the door and preventing unauthorized access to the structure by impeding, dissipating, and transferring forward motion force.

2 Claims, 7 Drawing Sheets

(56) References Cited

U.S. PATENT DOCUMENTS

| | | | | |
|---|---|---|---|---|
| 5,868,015 | A * | 2/1999 | Eaker | E05B 67/383 292/148 |
| 6,352,290 | B1 * | 3/2002 | Scottino | E05B 65/0014 292/259 R |
| 6,644,698 | B1 * | 11/2003 | Christensen | E05C 19/003 292/259 R |
| 7,226,093 | B1 * | 6/2007 | Stailey | E05C 19/003 292/259 R |
| 7,350,837 | B1 * | 4/2008 | Faires | E05C 19/003 292/259 R |
| 7,628,430 | B2 * | 12/2009 | Whitaker | E05C 19/003 292/259 R |
| 7,661,733 | B1 | 2/2010 | Angel | |
| 2010/0064585 | A1 * | 3/2010 | Gertz | E05C 19/003 49/70 |

* cited by examiner

DOOR SECURITY DEVICE

BACKGROUND OF THE INVENTION

1. Technical Field

This device relates to entry security systems, specifically door securing devices for preventing unauthorized forced entry through an exterior door.

2. Description of Prior Art

Prior art devices for securing entrance doors principally comprised of doorknob locks, deadbolts, and security chains. A variety of auxiliary door access securing devices have been developed directed to multiple deadbolts, and bars that extend across the door to prevent access; see for example, U.S. Pat. Nos. 4,602,720, 5,290,077, 5,580,108, 5,669,641 and 7,661,733 B1.

U.S. Pat. No. 4,602,720 claims a locking bar for pivoting doors on containers having a bar fixed across an end wall with two locking devices disposed in space-relation to one another adapted to the specific corner fittings.

U.S. Pat. No. 5,290,077 illustrates a multiple door lock system with lock bolts that can be activated uniformly.

U.S. Pat. No. 5,580,108 discloses a door securing bar device that swivels from a pivot attachment point across the door to a bar latch.

U.S. Pat. No. 5,669,641 has a door securing system comprised of a pivoted anchor, a latch anchor with a telescoping crossbar, having pivoted sections and a positional bumper plate engaged against the door.

Finally, in U.S. Pat. No. 7,661,733 B1 a door reinforcing device is disclosed having a pair of face plates, a main locking rod extending from a center lock engageable through respective locking plates, barring access to the door.

SUMMARY OF THE INVENTION

A door security, door guard device that when engaged on an entry door prevents forced opening by distributing intruder's applied force by transferring and displacing it to the structure surrounding the door. A door engagement bar is selectively inner-engageable by a steel security force pole that is removably secured to the building structures above and below the door opening. By transferring the physical dynamics of applied "forced forward motion" from a single force vector, the entry door remains in secured closed position.

DESCRIPTION OF THE PREFERRED EMBODIMENT

Figure 1:
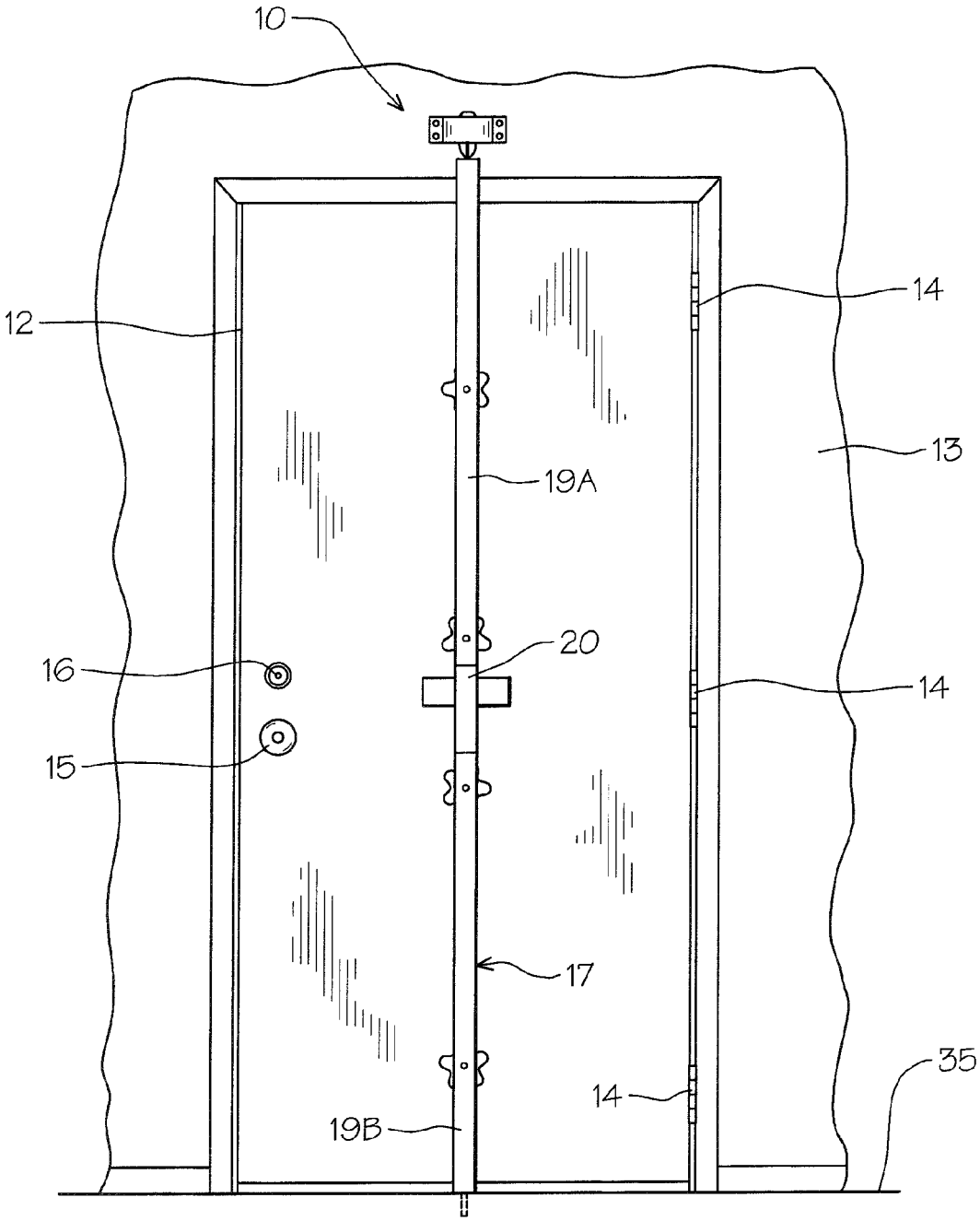
FIG. 1 is a front elevational view of the door security device of the invention installed and used on an exterior entryway door.

Referring to FIG. 1 of the drawings, the door security device 10 of the invention can be seen installed on an entry door 11, within a door frame 12 of a wall structure 13. The entry door 11 has multiple hinges 14 with a doorknob 15, and in this example, a keyed deadbolt 16 as typical and well-known in the art.

Figure 6:
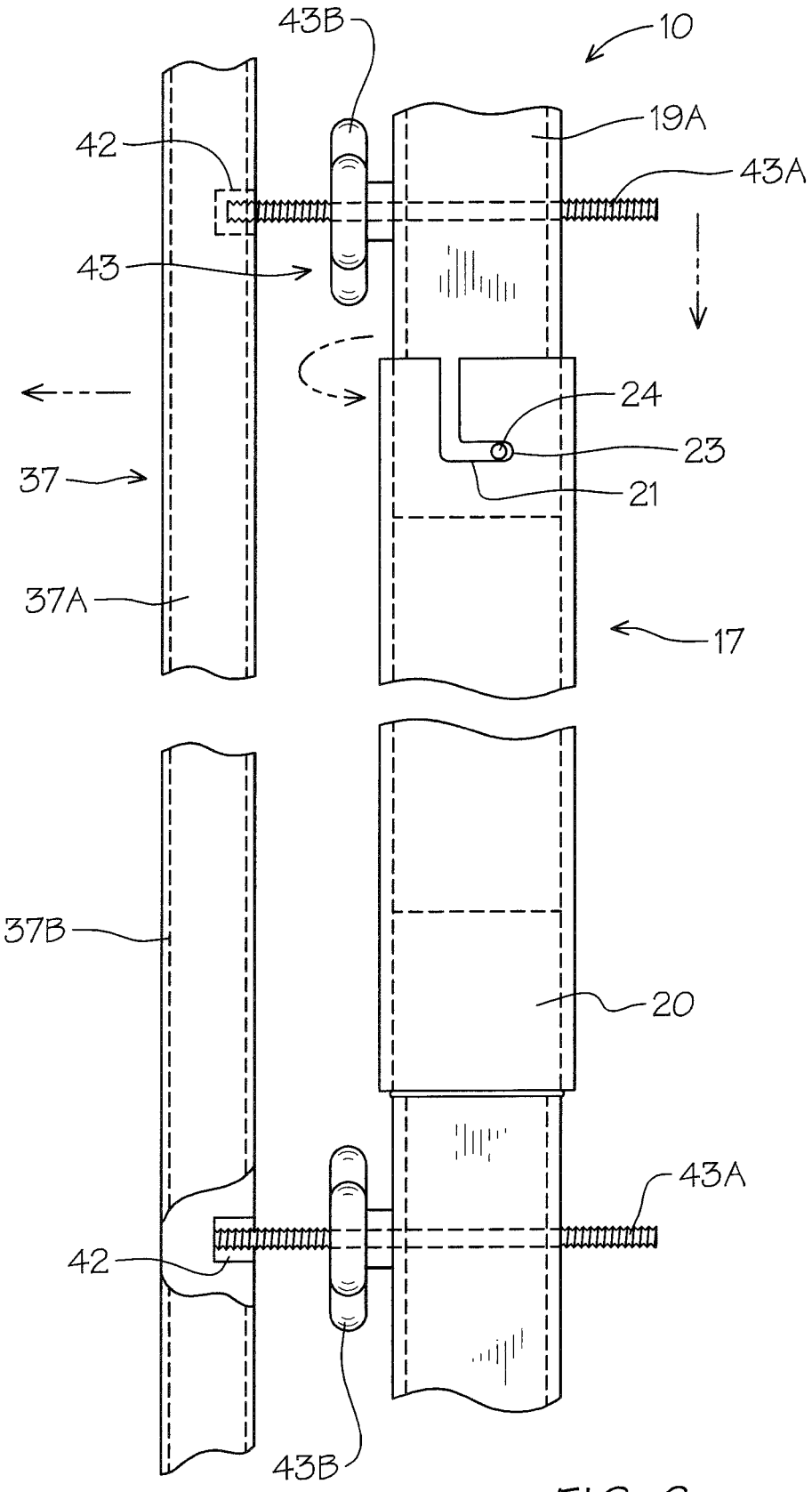
FIG. 6 is an enlarged partial side elevational view of the security pole brace interlocking assembly fitting with the door engagement bar.

The door security device 10 has a brace portion 17 and a door engagement portion adjustably engaged to one another. The brace portion 17 has a steel tubular pole brace 19 formed from a pair of inter-engaged tubular sections 19A and 19B. Each of the brace sections 19A and 19B are interlocked to one another by a slip sleeve fitting 20 best seen in FIG. 6 of the drawings. The slip sleeve 20 is welded over and on to the engagement of the brace pole 19B, having a locking tab receiving contoured slot 21 extending inwardly from its free end 22. The brace pole portion 19A has a locking lug 23 inwardly of its corresponding engagement end 24 for registration within the slot 21 during assembly by telescopic insertion of the pole brace 19A therewithin and locked by rotation of the lug 23 indicated by rotational arrow RA.

Figure 2:
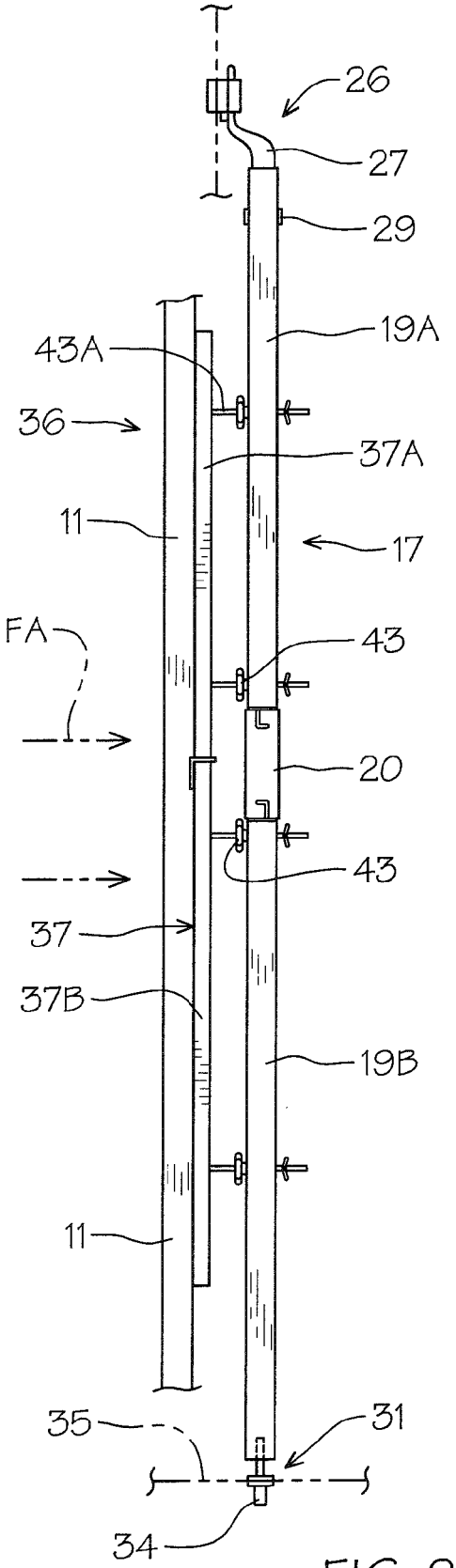
FIG. 2 is a side elevational view of the assembled door security device.
Figure 3:
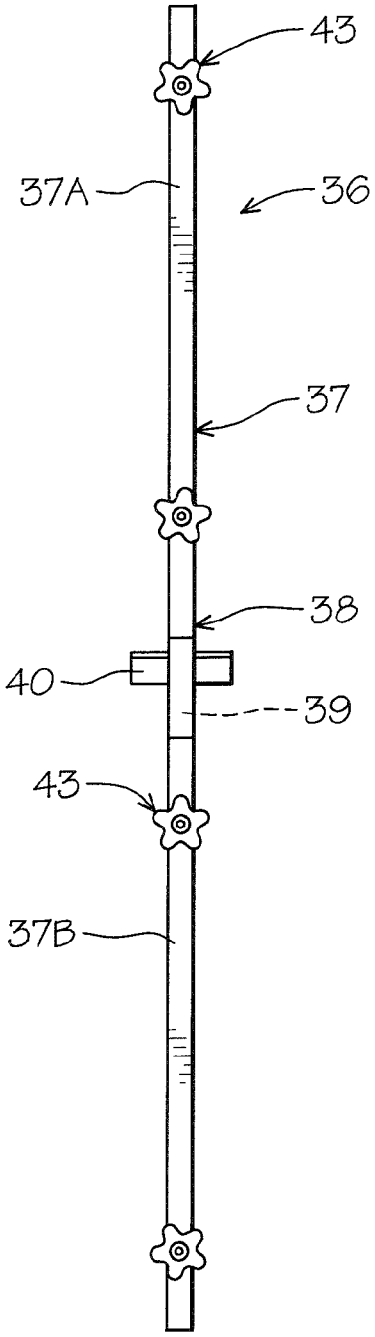
FIG. 3 is a front elevational view of the door engagement bar of the device.
Figure 4:
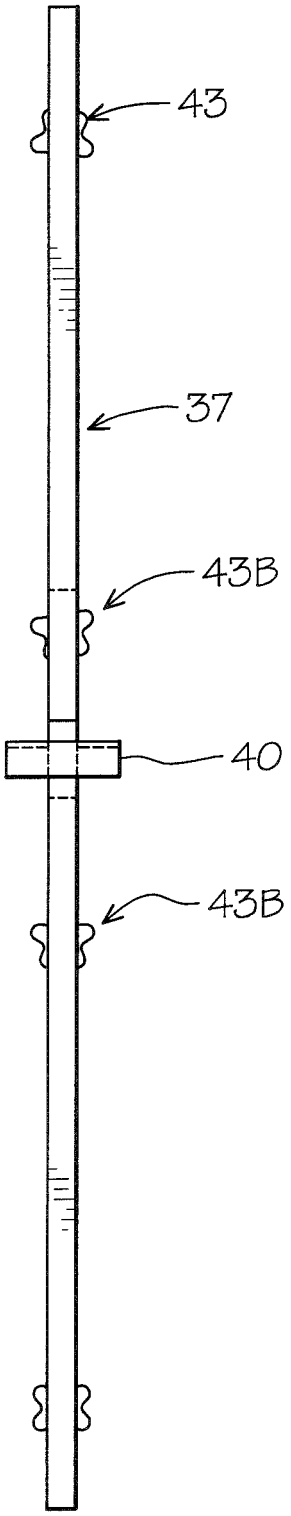
FIG. 4 is a rear elevational view of the door engagement bar.
Figure 5:
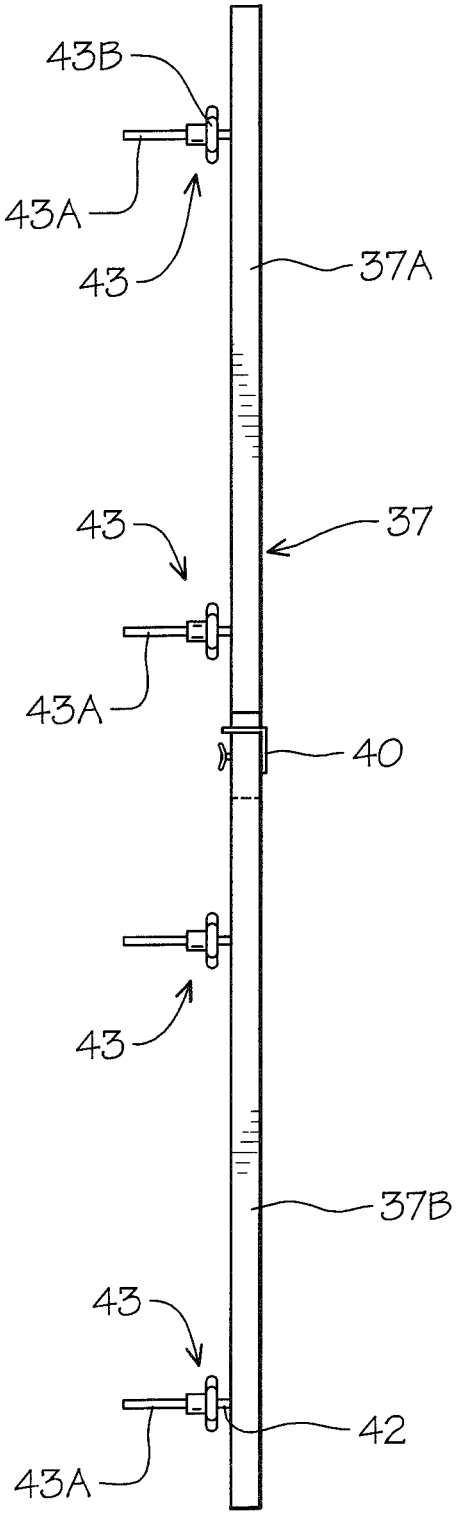
FIG. 5 is a side elevational view thereof.
Figure 10:
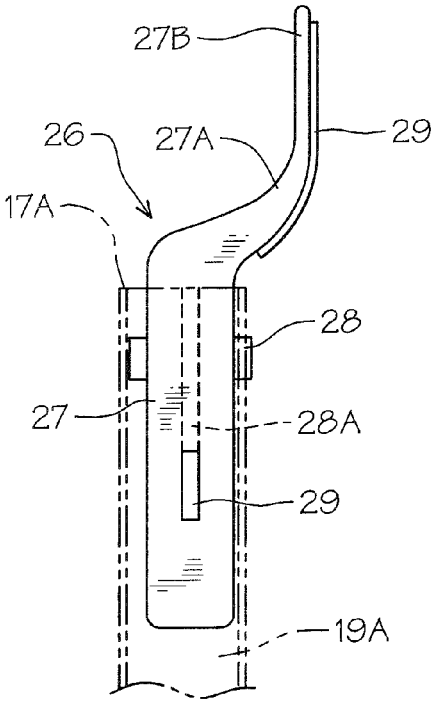
FIG. 10 is an enlarged side elevational view of the seat retainment arm in solid lines with the pole brace and engagement bracket in broken lines.
Figure 11:
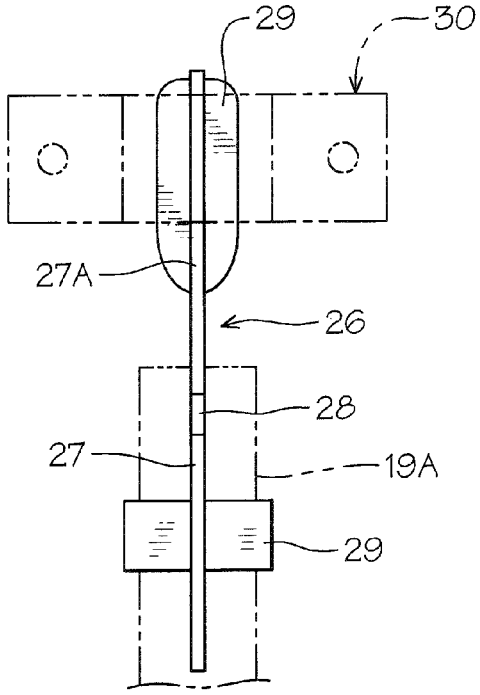
FIG. 11 is an enlarged front elevational view thereof.

Referring now to FIGS. 2, 10 and 11 of the drawings, a seat pole retainer insert 26 can be seen having a generally flat main body member 27 with a longitudinally offset extending portion 27A. The body member 27 has two pairs of oppositely disposed tabs 28 and 29 in longitudinally and angularly space relation to one another extending therefrom. The seat pole retainer insert 26 is slidably received in a pair of aligned slots 28A and 28B in the pole brace end portion 17A shown in broken lines in FIGS. 10 and 11.

The offset portion 27A has a contoured stabilization plate 29 secured on its edge 27B so as assembled it can be slidably disposed within a wall frame bracket 30 secured to the wall structure 13 above the door 11, as will be described in greater detail hereinafter.

Figure 12:
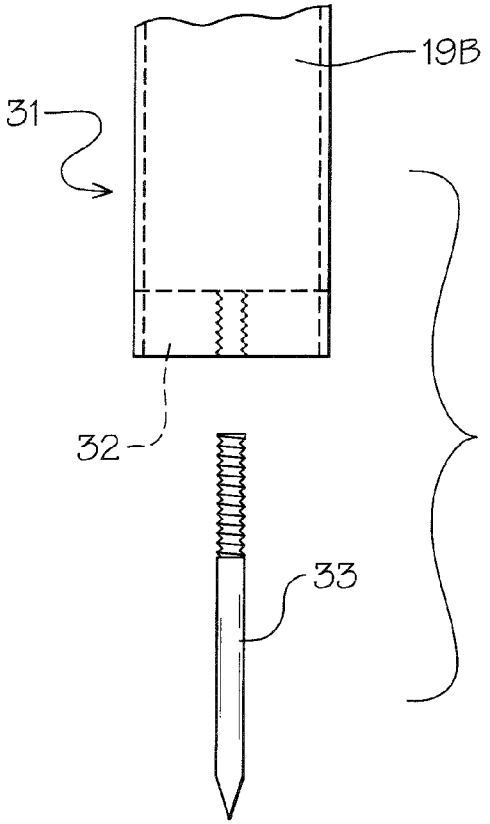
FIG. 12 is an enlarged partial side elevational composite view of the pole brace threaded insert fitting and pin.
Figure 13:
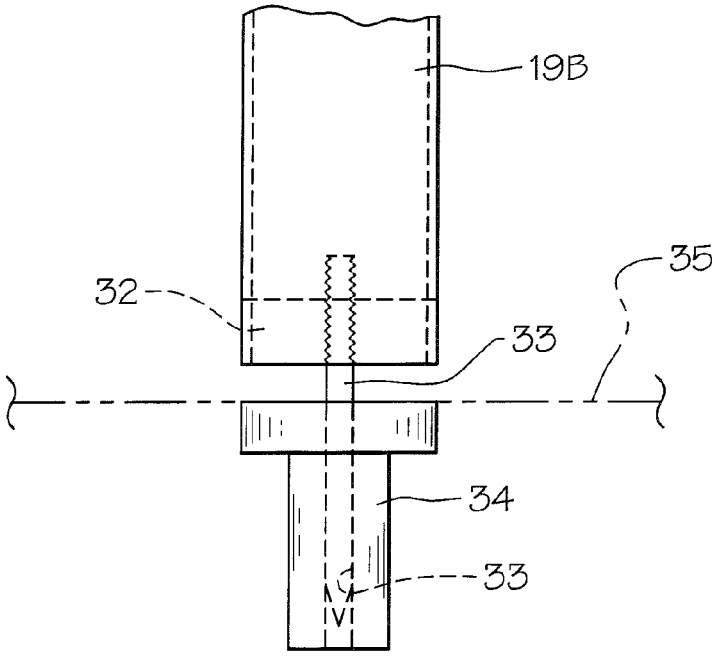
FIG. 13 is an enlarged partial side elevational view of the assembled pole brace fitting and pin with pin receiving fitting.

Correspondingly, a pole brace positioning and securing pin assembly 31 as seen in FIGS. 2, 12 and 13 of the drawings in which in this example has a threaded insert fitting 32 secured in the pole brace section 19 for receiving a threaded pin 33. A correspondingly aligned pin receiving fitting 34 is embedded within the floor surface 35 directly in front of the door 11 in vertical alignment with the wall frame bracket 30, as will be evident to those skilled within the art.

A door engagement push bar assembly 36 can be seen in FIGS. 2 through 5 and 7 through 9 of the drawings, which is in select registrational alignment with the brace pole 19 and by adjustable engagement engaged against the surface 11A of the door 11, securing same as will be described.

Figure 8:
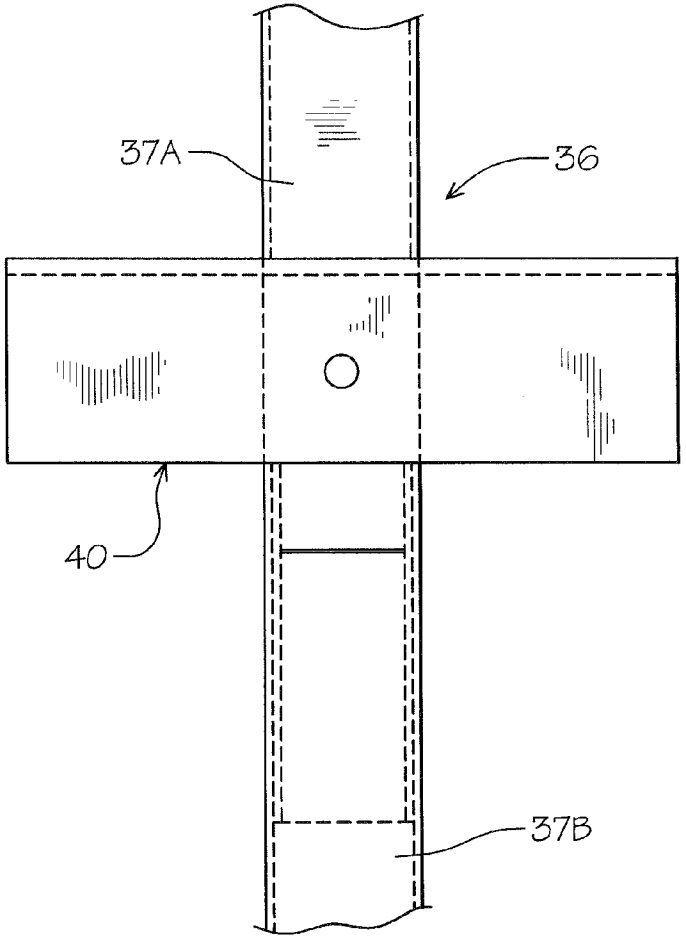
FIG. 8 is an enlarged partial rear elevational view of the door engagement bar, central assembly fitting, and stabilization plate.
Figure 7:
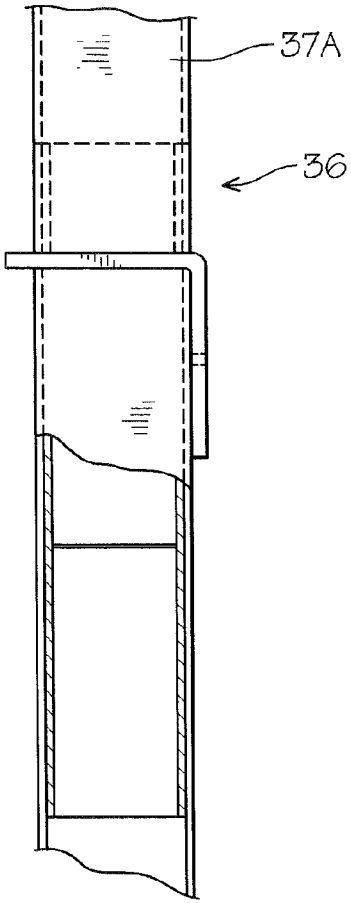
FIG. 7 is an enlarged partial sectional view of the door engagement bar assembly fitting and stabilization plate.
Figure 9:
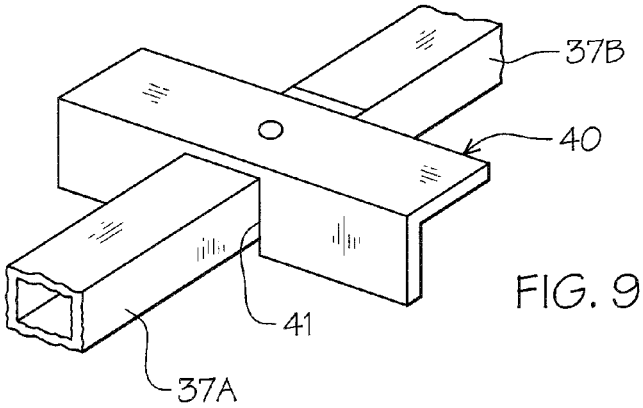
FIG. 9 is a partial respective view thereof.

The push bar assembly 36 is comprised of a tubular push bar 37 formed by a pair of inter-engaging tubular bar sections 37A and 37B, inter-engaged telescopically at 38, best seen in FIGS. 7 and 8 of the drawings by an insert fitting 39 extending from tubular bar section 37B of a reduced cross section.

A center bar stabilizer angle 40 is notched at 41 and mounted over the bar section 37A by a fastener F. The bar stabilizer angle 40 is of an equilateral dimension with a length at least three times the known dimension of said respective bar sections 37A on which it is mounted.

Each of the bar sections 37A and 37B have a pair of longitudinally spaced threaded apertures 42 for threadably receiving an adjustment fitting 43 having a threaded pin 43A and a hand engagement knob 43B threadably disposed thereon.

As assembled as seen in FIGS. 1 and 2 and in use, the door security device of the invention is slipped into position for engagement with the door 11. The pole brace portion 17 assembled as hereinbefore disclosed with the push bar assembly 36 is slidably engaged into the wall frame bracket 30 on the wall frame structure 13 and the pin receiving fitting 34 embedded into the floor surface 35 as seen in FIG. 1 and graphically in FIG. 2 of the drawings.

The door engagement push bar assembly 36 is then adjustably advanced for door engagement by the selective rotation of the adjustment knobs 43B as seen graphically in FIG. 2 of the drawings.

As installed, the door security device will reinforce the door 11, transfer applied forced vectors indicated by force arrows FA thereby preventing forward force motion entry of the door by forced displacement as engaged by the security door device 10 as hereinbefore described.

It will be evident to those skilled in the art that various changes, modifications, may be made thereto without departing from the spirit of the invention. Therefore I claim:

The invention claimed is:

1. A door security device mounted on the inside of a door to prevent forced entry, the door security device comprises:

an adjustable door engagement bar positioned against said door;

a pole brace;

a wall bracket anchored to a stud within a wall forming structure adjacent said door at a position above the center of the overall height of said door;

a floor fitting in vertically aligned position with said wall bracket;

a seat pole retainer insert having a longitudinal offset wall bracket engagement portion having one end secured to said wall bracket and alignment and stabilization tabs for securing the opposed end of said insert within said pole brace;

a floor fitting engagement pin extending from said pole brace end in opposed relation to said seal pole retainer insert, configured to be secured within the floor fitting;

multiple adjustment fittings extending between said pole brace and said door engagement bar for secure said pole brace in an aligned parallel spaced relation with said door engagement bar;

and an angled fitting on said door engagement bar for direct engagement with said door when so engaged.

2. The door security device set forth in claim 1 where in said pole brace and said door engagement bar are made of steel material.

* * * * *